US008960733B1

(12) United States Patent
Smith

(10) Patent No.: US 8,960,733 B1
(45) Date of Patent: Feb. 24, 2015

(54) LATCH DEVICE FOR SCREEN DOOR

(71) Applicant: Atwood Mobile Products, LLC, Elkhart, IN (US)

(72) Inventor: Mark L. Smith, Buchanan, MI (US)

(73) Assignee: Atwood Mobile Products, LLC, Elkhart, IN (US)

( * ) Notice: Subject to any disclaimer, the term of this patent is extended or adjusted under 35 U.S.C. 154(b) by 0 days.

(21) Appl. No.: 13/924,360

(22) Filed: Jun. 21, 2013

Related U.S. Application Data

(60) Provisional application No. 61/663,075, filed on Jun. 22, 2012.

(51) Int. Cl.
*E05C 1/12* (2006.01)
*E05C 7/02* (2006.01)

(52) U.S. Cl.
CPC . *E05C 7/02* (2013.01); *Y10S 292/30* (2013.01)
USPC ..... 292/165; 292/167; 292/126; 292/226; 292/197; 292/200; 292/336.3; 292/DIG. 30

(58) Field of Classification Search
USPC ..... 292/65, 226, 197, 200, 336.3, DIG. 30, 292/1, 137, 138, 163, 173, 143, 194, 195, 292/219, 220, 92
See application file for complete search history.

(56) References Cited

U.S. PATENT DOCUMENTS 543,506 A * 7/1895 Preston ..... 70/137
1,675,176 A * 6/1928 Jarecki ..... 292/332
1,840,163 A * 1/1932 Hersch et al. ..... 292/164
2,055,688 A * 9/1936 Halinka ..... 292/153
2,311,686 A * 2/1943 Olson ..... 292/126
2,690,347 A * 9/1954 Erkkila ..... 292/226
2,694,590 A * 11/1954 Goserud ..... 292/66
2,725,250 A * 11/1955 Fiedorczyk ..... 292/167
2,726,533 A * 12/1955 Quinn ..... 70/153
2,745,691 A * 5/1956 Moloney et al. ..... 292/123
2,776,157 A * 1/1957 Ellis ..... 292/126
2,825,250 A * 3/1958 Bennett et al. ..... 72/122
4,902,054 A * 2/1990 Swanson ..... 292/254
5,028,082 A * 7/1991 Kronbetter ..... 292/128
6,009,932 A * 1/2000 Smith ..... 160/371
6,322,113 B1 * 11/2001 Ayers et al. ..... 292/336.3
2006/0214436 A1 * 9/2006 Wheatland et al. ..... 292/336.3
2008/0042450 A1 * 2/2008 Jianping et al. ..... 292/216

* cited by examiner

*Primary Examiner* — Kristina Fulton
*Assistant Examiner* — Thomas Neubauer
(74) *Attorney, Agent, or Firm* — Michael A. Myers; Myers & Associates

(57) ABSTRACT

A new latch device for a screen door includes inside and outside handle assemblies. Each assembly has a lever adapted to be pivotably connected, respectively, to the inboard and outboard side of the screen door. The inboard lever has a paddle at one end and a stem at the other. The stem extends through an opening formed in the screen door. When the paddle is depressed, the stem moves along a cam surface formed in the outboard lever. This causes the outboard lever to disengage the fastener on the solid door to disconnect the solid door from the screen door. Additionally, when the screen door is in its latched position and not connected to the solid door, depressing the paddle causes the latching end of the outboard lever to disengage the doorjamb so that the screen door can be moved independently from its latched position into its open position.

11 Claims, 6 Drawing Sheets

LATCH DEVICE FOR SCREEN DOOR

REFERENCE TO RELATED APPLICATION

This application claims priority to U.S. Provisional Application No. 61/663,075, filed Jun. 22, 2012, which is hereby incorporated by reference.

BACKGROUND OF THE INVENTION

Screen doors used with recreational vehicles, campers and trailers are designed to attach to the inside of a solid security door. The fastener connecting the doors together is usually located in the central portion of the door with the handle and locking mechanisms for the security door. Since it is desirable to open and close either door independently of the other, a sliding panel in the midsection of the screen door, like the one illustrated in FIG. 1, typically provides access to the fastener. There, the screen door may be disconnected from the solid door.

To separate the doors, one must slide open the panel release the latch to the solid door and then unlatch or push open the screen. This makes it impossible to carry anything through the doorjamb without first opening the doors because only one hand may be free while doing so. Another problem is that it's easy to forget to slide the panel closed after separating the doors, and insects may enter as a result. Like many prior screen door latches with too many mechanical parts, the sliding panel is also subject to wear and eventual failure.

Thus, it would be advantageous to provide an improved latch device for a separating the screen door from the solid one. It is also desirable to be able to open the screen door hands free. It would also be novel if the latch device had few moving parts.

SUMMARY OF THE INVENTION

The new latch is particularly useful for a screen door of the type used with recreational vehicles, trailers and campers characterized in that the screen door may be releasably attached to the interior side of the solid door. The new latch device functions to release the screen door from engagement with the solid security door and functions to unlatch the screen door from the doorjamb when the screen door is not connected to the solid door.

The latch device includes a first handle assembly for mounting on the inboard side of a screen door. The first assembly includes a base, and a lever with a stem at one end and a paddle at the other. The lever is adapted to be pivotably connected to the base so that the paddle is inboard and the stem is outboard relative to the base. A second handle assembly is mounted on the outboard side of the screen door. The second handle assembly includes a housing having an opening, and a lever having a forward end, a latch end and a foot. The lever includes a cutout having a cant surface. The lever is adapted to be pivotably supported in the housing of the second handle assembly and constantly biased toward a latched position.

In one aspect of the invention, the stem of the lever of the first handle assembly is positioned in the cutout of the lever of the second handle assembly so that when the paddle is depressed, the lever of the first handle assembly pivots and the stem moves upwardly along the cam surface moving the lever of the second handle assembly downward from the latched position to an unlatched position, so that the solid door and the screen door can be disconnected, and so that the screen door can be moved from its latched position to its open position.

One object of the invention is to provide an improved latch for a RV screen door and solid door that enables detachment of the solid door from the screen door and enables the screen door to be opened hands-free from the latched position on the doorjamb. Related objects and advantages of the invention will be apparent from the following description.

BRIEF DESCRIPTION OF THE DRAWINGS

The details of the invention, both as to its structure and operation, may be obtained by a review of the accompanying drawings, in which.

DETAILED DESCRIPTION OF INVENTION

Figure 1:
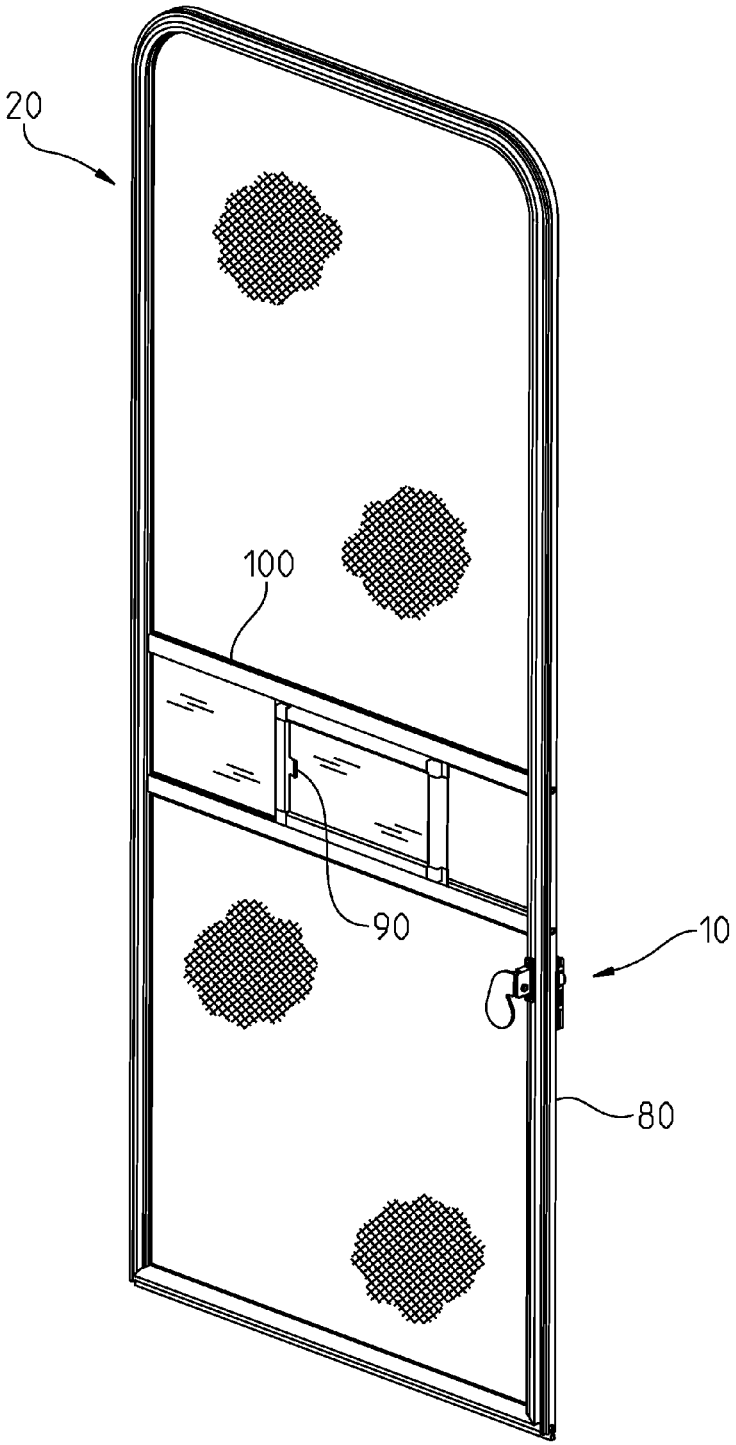
FIG. 1 is an inside elevation view of a screen door with a sliding cover and opening in its midsection showing the latch of the invention installed below the partition.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

The terms "inboard" and "inside" as well as the terms "outboard" and "outside" are used throughout this application interchangeably and should be construed to mean, respectively, inside and outside, that is "inboard" and "inside" mean inside and "outboard" and "outside" mean outside.

With reference to FIGS. 1-5, a latch device 10 for a screen door 20 includes inside and outside handle assemblies 30, 50 each having, respectively, an inside handle assembly lever 32 and an outside handle assembly lever 52. The inside handle assembly has a base 31, and the outside handle assembly has a housing 61. Each base 33 and housing 61 connects the inside and outside handle assembly 30, 50, respectively, to the inside and outside of a screen door 20.

One end 36 of the inside handle assembly lever 32 consists of a teardrop shaped paddle 35 that presents a large flat plan surface of disproportionately large surface area relative to the latch as a whole against which pressure is applied to operate the latch. A stem 42 with a terminal end 43 extends outwardly from the paddle. In one embodiment, the paddle 35 is between about 4-8 times larger than the width of the stem 42. The inside handle base 33 includes an enclosed structure 41 that has a bottom, walls 34 upstanding from the bottom, and sides 44. A bore 37 extends through the walls 34, and an aperture 31 extends through the midsection of the lever 32.

The handle assemblies 30, 50 as well as their corresponding components are formed from a rigid material, preferably molded plastic. The plastics used are well known in the field and may include UV stabilizers to prevent deterioration due to UV exposure. The assemblies may be fastened to the inboard and outboard surfaces of the frame of the screen door 20, preferably at location below the midsection, as shown in FIG. 1, using known fasteners such as screws, rivets and the like.

Figure 2:
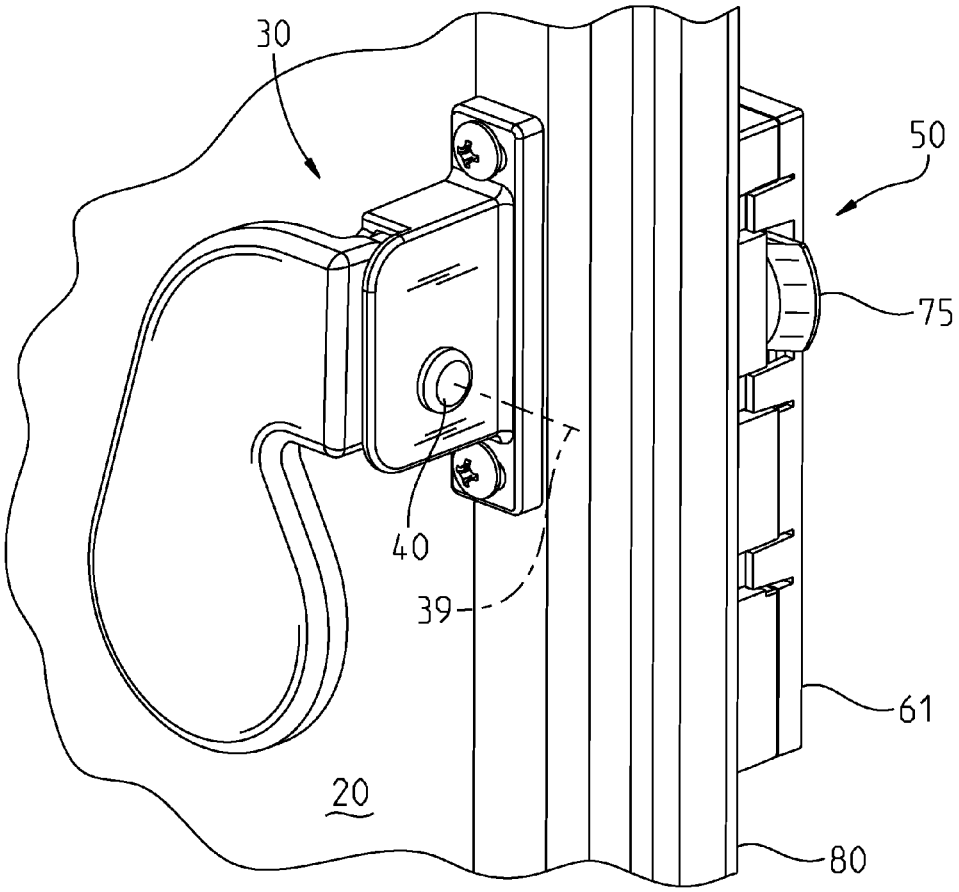
FIG. 2 is an enlarged view of the inside and outside handle assemblies of the invention shown mounted to a screen door frame.
Figure 3:
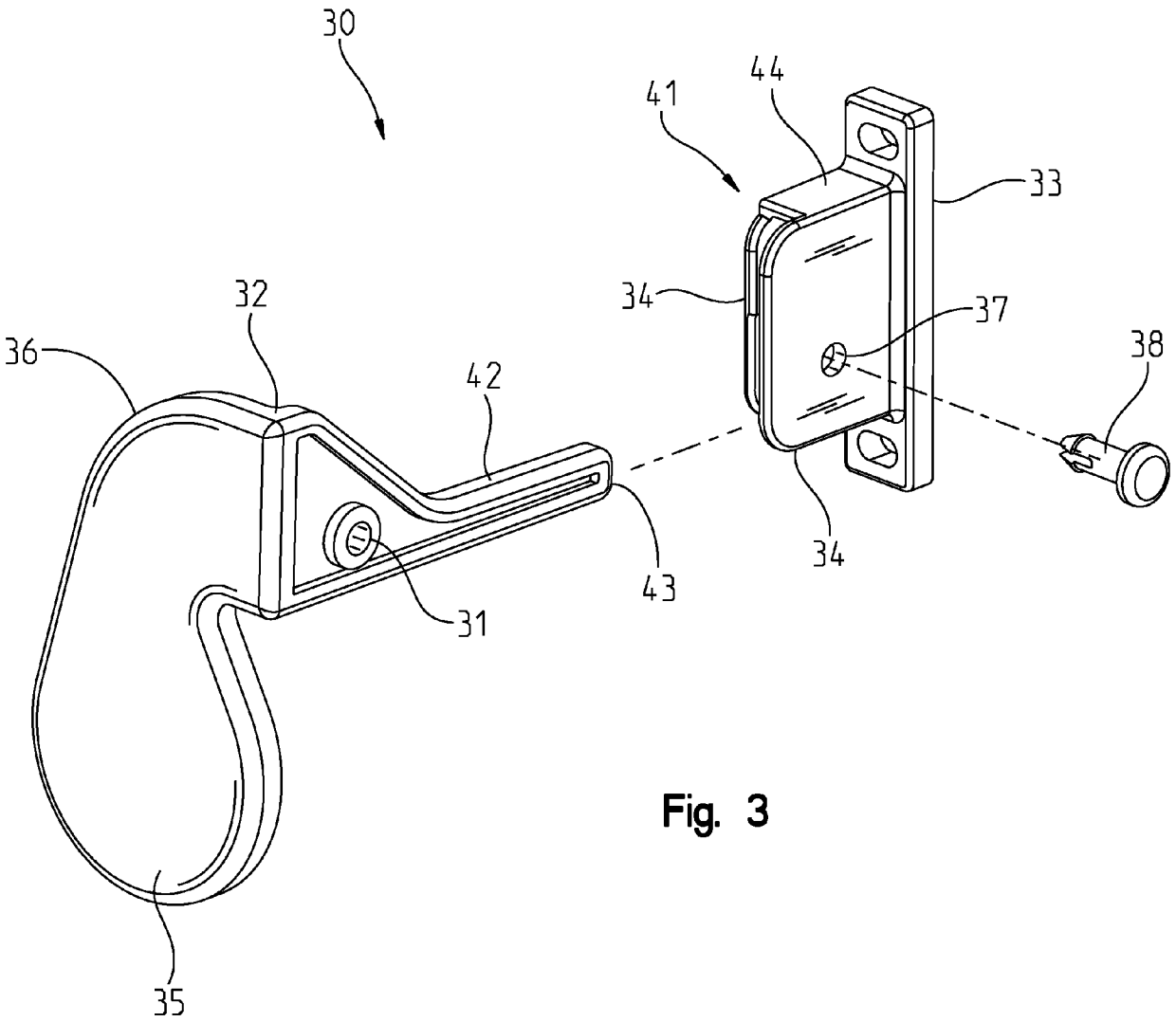
FIG. 3 is an exploded view of the inside handle assembly.

The inside handle assembly 30 includes a pivot pin 38. The aperture 31 in the lever 32 is aligned with the bore 37 when the inside handle assembly lever 32 is positioned in the enclosed structure 41. The pin 38 passes through both the bore and aperture to connect the lever and the base 30 to define a pivot point 40 with an axis 39, as shown in FIG. 2.

Figure 4:
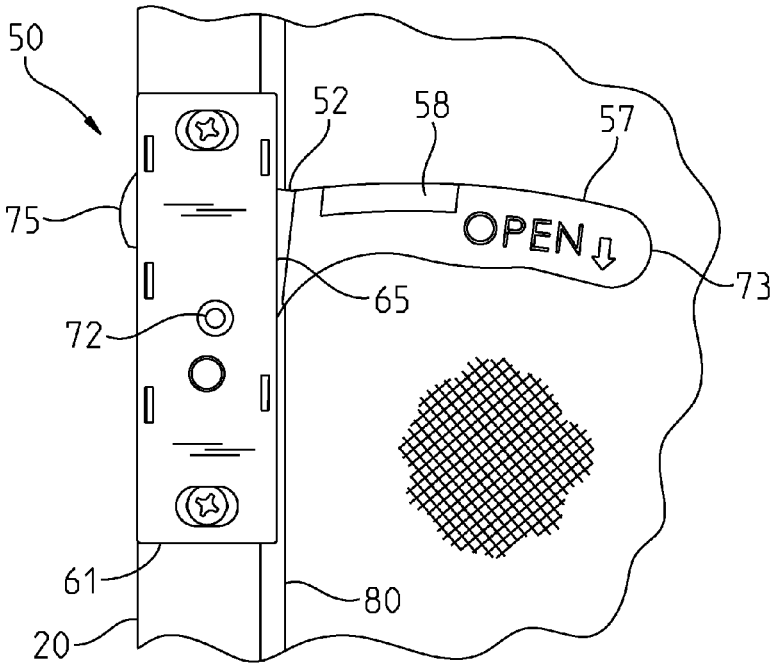
FIG. 4 is a perspective view showing the outside handle assembly with its lever in the unlatched position.
Figure 5:
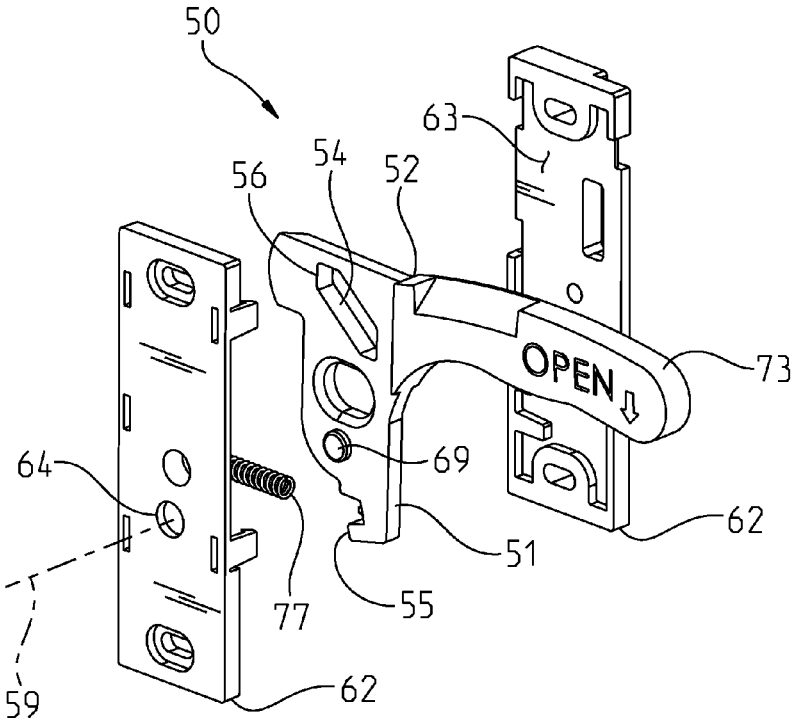
FIG. 5 is an exploded view of the outside handle assembly.
Figure 7:
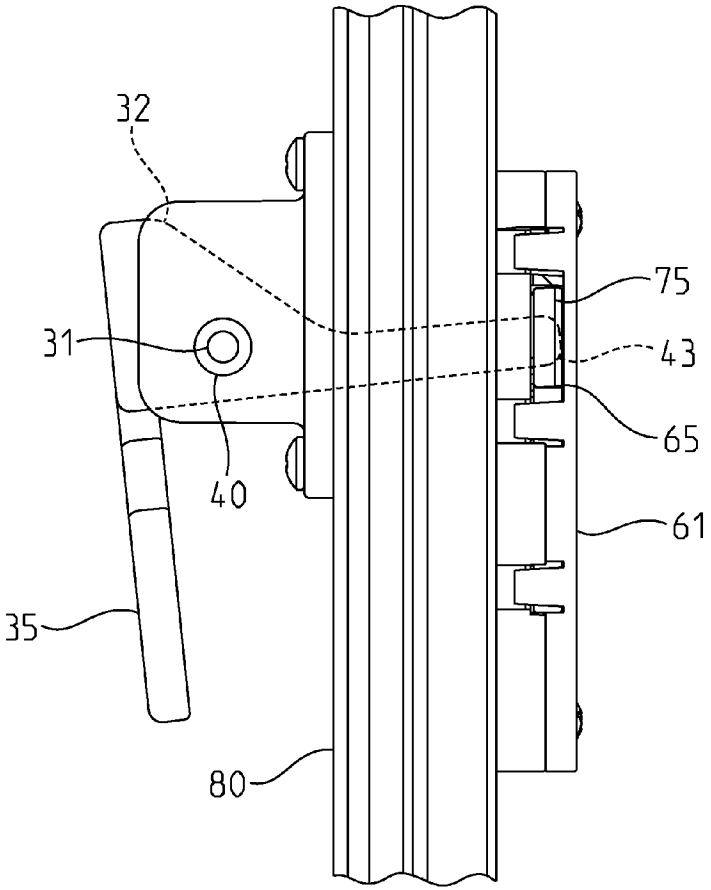
FIG. 7 is a side plan view like the view of FIG. 6 showing the lever of the inside handle assembly in phantom lines pivoting moving the lever of the outboard handle assembly downward.
Figure 6:
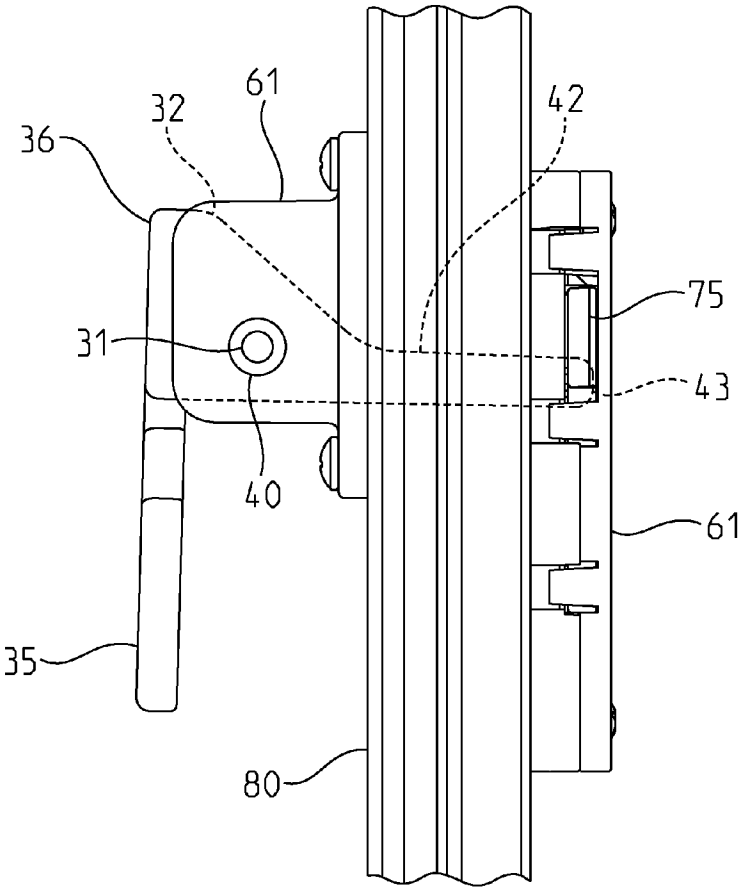
FIG. 6 is a side plan view of the screen door without the solid security door showing the lever of the inside handle assembly in phantom lines extending through the screen door and into the housing of the outboard handle assembly, which is shown in the latched position.
Figure 9:
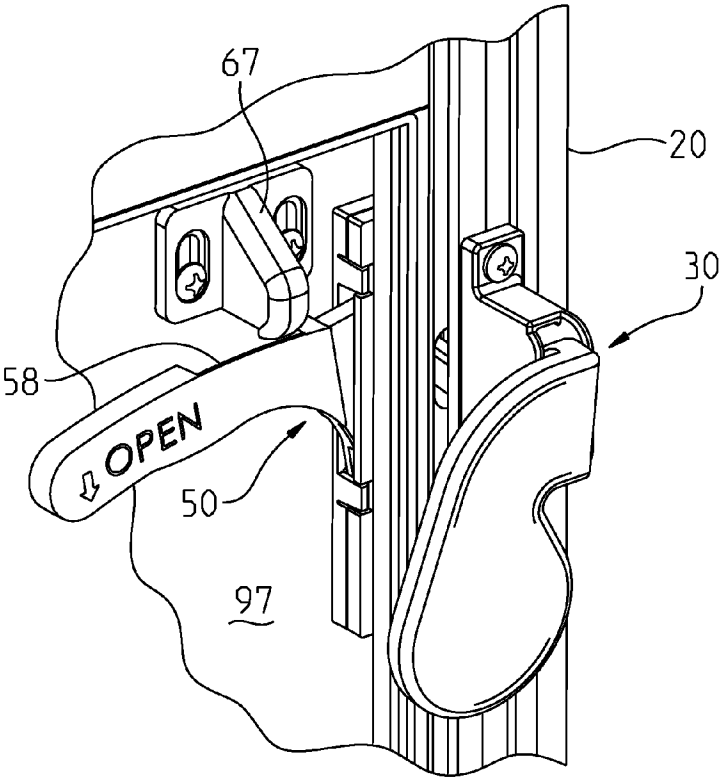
FIG. 9 is an isometric view of the latch device showing the lever of the outside handle assembly disengaged from the fastener on the solid door.
Figure 8:
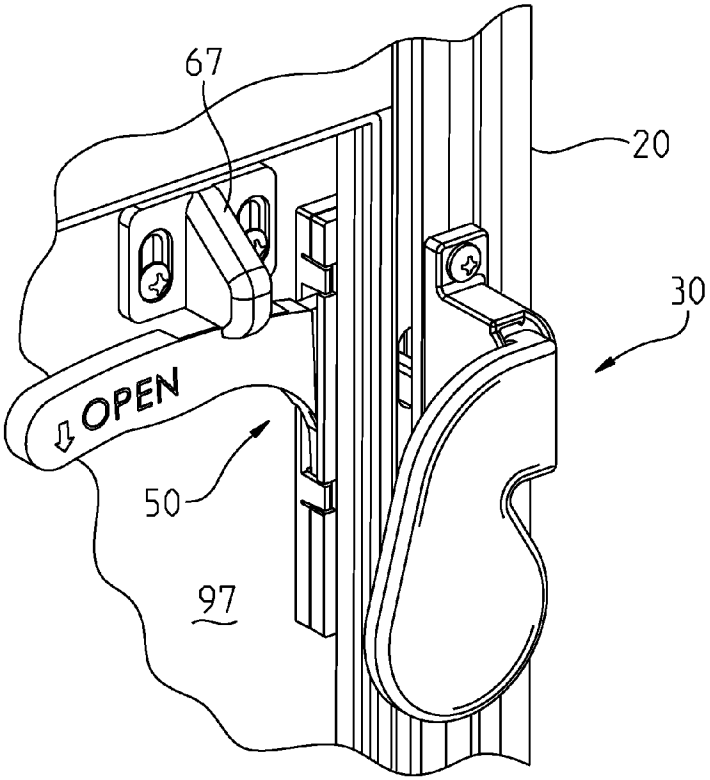
FIG. 8 is an isometric view of the latch device showing the screen door connected to the solid door by the fastener.

Referring to FIGS. 4-8, the outside handle assembly lever 52 is formed generally in the shape of an L and includes cutout 56 formed in the bottom of its leg at the beginning of the foot 51, which terminates at cradle 55. The top surface of the top 57 of lever 52 includes a sloped portion 58 for cooperatively engaging the fastener 67 of the solid door 97 (FIGS. 8-9). A spring 77 resides in the cradle and constantly urges the lever 52 toward a latched position, as shown in FIGS. 6 and 8. The leg of the "L" has a forward end 73 and a latch end 75. In an embodiment, the cutout 56 has a sloped cam surface 54 upon which the stem 42 of the inside handle assembly lever 32 travels when the latch device 10 is engaged (FIGS. 5-7).

It will be apparent to those skilled in the art, that is, those who have knowledge or experience in this area of technology, that many uses and design variations are possible for the inboard and outboard handle assemblies 30, 50, including the levers disclosed herein. The cutout 56 with the cam surface 54, for example, may be a sloped channel within which the stem 42 slides or is guided. In yet another design, a lip or protrusion is formed in the body of the lever 52, and the stem 42 contacts the lip to depress the outside handle assembly lever 52.

The outside handle assembly 50 includes an enclosed base, or housing 61 with mating sidewalls 62 each with a bore 64. The sidewalls are complementarily shaped and configured such that an opening 65 is defined when they are mated and fastened together by known fastening means. The forward end 73 of the L-shaped lever 52 extends outwardly through the opening when the sidewalls sandwich the lever 52, as shown in FIG. 4. Additionally, enclosure of the walls about the outside handle assembly lever 52 positions nipples 69, which are located on both sides of lever 52, into bores 64 in sidewalls 62 in a manner so as to fasten the lever 52 to the housing 61 and enable the lever 52 to pivot relative to the base at a pivot 72 with an axis 59.

The levers 32, 52 of the inside and outside handle assemblies 30, 50, respectively, are configured so that the pivot axis 39 of the inside handle assembly lever 32 is transaxially arranged relative to the pivot axis 59 of the outside handle assembly lever 52. Pivot axes 39, 59 are directed at right angles to each other. This configuration aligns the working end 43 of the stem 42 with the cutout 56 of the outside handle assembly lever 52. The cooperation of numerous interrelated mechanical parts is therefore unnecessary. As described below, movement of the inside lever directly effects operation of the outside lever.

Skilled artisans will recognize other appropriate designs that may be reversed from the one illustrated to pivotably support the levers. In one embodiment, for example, protrusions extend inwardly (not shown) one each from the interior surface 63 of a respective sidewall. The ends of the protrusions meet to define a pivot disposed in a bore formed in the body of lever 52.

Referring to FIGS. 6-7 and 8-9, the new latch device functions to release the screen door from engagement with the solid security door (FIGS. 8-9) and functions to unlatch the screen door from the doorjamb when the screen door is not connected to the solid door (FIGS. 6-7). In use, when the paddle 35 of the inside handle assembly lever 32 is depressed, the end 43 of stem 42 moves along the cam surface 54 moving the outboard lever 52 so that the lever disengages the fastener 67 on the solid door to disconnect the solid door 97 to disconnect the solid door from the screen door 20 (FIG. 9), and when the screen door is in its latched position (FIG. 6) and not connected to the solid door, depressing paddle 35 causes the latching end 75 of the lever 52 to disengage the doorjamb (FIG. 7) so that the screen door can be moved independently from the latched position into the open position.

Because of the size and location of paddle 35, a user may apply pressure to it with an elbow or hip to disengage the latch device 10 hands free. Additionally, the levers 32, 52 of the inside and outside handle assemblies 30, 50 are configured so that the pivot axis 39 of the inside lever 32 is directed at a right angle to the pivot axis 59 of the outside lever 52. That is, the pivot axes 39, 59 are transaxially arranged. The levers 32, 52 make direct contact with each other as a result, and fewer parts are necessary to operate the new screen latch 10.

For the purposes of promoting an understanding of the principles of the invention, specific embodiments have been described. It should nevertheless be understood that the description is intended to be illustrative and not restrictive in character, and that no limitation of the scope of the invention is intended. Any alterations and further modifications in the described components, elements, processes, or devices, and any further applications of the principles of the invention as described herein, are contemplated as would normally occur to one skilled in the art to which the invention relates.

The invention claimed is:

1. A latch device for a screen door, the screen door is hingedly supported in a doorjamb and releasably connected to a solid door also hinged supported in the door jamb the doors are movable together as a single unit or independently of each other between respective latched and open positions, a handle assembly connected to an outboard side of the screen door is adapted to releasably connect the screen door and the solid door the latch device comprising:

an inboard handle assembly for mounting on an inboard side of a screen door, the inboard handle assembly includes an inboard lever having opposite ends with a stem at one end and a paddle at the other end, the inboard lever is adapted to be pivotably connected to the inboard side of the screen door so that the stem passes through the screen door to the outboard side of the screen door; and an internal cam surface formed inside a cutout of an outboard lever pivotably supported by a handle assembly connected to the outboard side of the screen door for receiving the stem of the inboard handle assembly, and for guiding movement of the stem when force is applied to the paddle of the inboard lever; and a fastener positioned between the solid door and the screen door adapted for engagement with the outboard lever for releasably securing the screen door and the solid door together.

2. A latch device according to claim 1, wherein said cam surface is a sloped cutout extending through the outboard lever, said stem of the inboard lever traveling within the cutout when force is applied to the paddle.

3. A latch device according to claim 2, wherein said inside handle assembly further comprising a pivot pin, the inside handle assembly includes a base having a wall with a bore extending through the wall, and the pin resides in said bore and in an aperture formed in the inboard lever.

4. A latch device according to claim 2, wherein the lever of the outboard handle assembly includes a forward end, a latch end and a foot with cradle, the cutout is located between the forward end and the latch end.

5. A latch device according to claim 4, wherein the lever of the outboard handle assembly is supported in a housing connected to the outboard side of the screen door, and a wall of the housing has an opening through which the stem of the inboard lever extends.

6. A latch device for a screen door, the screen door is hingedly supported in a doorjamb and releasably connected to a solid door also hingedly supported in the doorjamb, the doors are movable independently of each other or together as a single unit between a latched position and an open position, the latch device comprising:

inside and outside handle assemblies each having a lever adapted to be pivotably connected, respectively, to the inboard and outboard side of the screen door, each lever includes a pivot axis, the outside lever further comprising a forward end, a latching end for engagement with the doorjamb, and a sloped portion between the forward and latching ends for engaging a fastener on a solid door, the outside lever further comprising a cutout having an internal cam surface; and a fastener on the inboard side of the solid door for releasably engaging the sloped portion of the outside lever to secure the screen door and the solid door together, wherein when one end of the inside handle assembly lever is depressed, the lever pivots, and a terminal end portion of said lever moves along the cam surface moving the outboard lever so that the outboard lever disengages the fastener on the solid door to disconnect the solid door from the screen door.

7. A latch device according to claim 6, wherein said cam surface is a cutout extending through the outside lever between the forward end and the latching end, a stem of the inside lever traveling within the cutout when force is applied to the inside lever.

8. A latch device according to claim 7, wherein said inside handle assembly further comprising a pivot pin, the inside handle assembly includes a base having a wall with a bore extending through the wall, and the pin resides in said bore and in an aperture formed in the inside lever.

9. A latch device according to claim 8, wherein respective pivot axes of the levers of the inside and outside handle assemblies are configured at right angles to each other.

10. A latch device for a screen door, the screen door is hingedly supported in a doorjamb and releasably connected to a solid door also hingedly supported in the doorjamb, the doors are movable independently of each other or together as a single unit between a latched position and an open position, the latch device comprising:

a first handle assembly for mounting on the inboard side of a screen door, the first handle assembly having a base, and an inboard lever having opposite ends with a stem at one end and a paddle at the other end, the lever is adapted to be pivotably connected to the base so that the paddle is inboard and the stem is outboard relative to the base;

a second handle assembly is mounted on the outboard side of the screen door, the second handle assembly having a housing with an opening, and a lever in the shape of an L having a forward end opposite a foot end, a latch end for engagement with the doorjamb and a foot, the lever of the second handle assembly has a cutout extending therethrough with a cam surface in the cutout, and said lever is adapted to be pivotably supported in the housing of the second handle assembly and constantly biased toward a latched position by a spring residing in a cradle formed in the foot.

11. A latch device according to claim 10, wherein respective pivot axes of the levers of the inside and outside handle assemblies are configured at right angles to each other.

* * * * *